US011794365B2

(12) United States Patent
Habermann et al.

(10) Patent No.: US 11,794,365 B2
(45) **Date of Patent: *Oct. 24, 2023**

(54) PERSONAL CARE APPLIANCE

(71) Applicant: The Gillette Company LLC, Boston, MA (US)

(72) Inventors: Judith Habermann, Frankfurt (DE); Alexander Tessmann, Neu-Anspach (DE); Hauke Bruening, Oberursel (DE)

(73) Assignee: The Gillette Company LLC, Boston, MA (US)

( * ) Notice: Subject to any disclaimer, the term of this patent is extended or adjusted under 35 U.S.C. 154(b) by 55 days.

This patent is subject to a terminal disclaimer.

(21) Appl. No.: 17/492,070

(22) Filed: Oct. 1, 2021

(65) Prior Publication Data

US 2023/0103785 A1 Apr. 6, 2023

(51) Int. Cl.

| | |
|---|---|
| ***B26B 21/46*** | (2006.01) |
| ***B26B 21/16*** | (2006.01) |
| ***B26B 21/22*** | (2006.01) |
| ***B26B 21/40*** | (2006.01) |

(52) U.S. Cl.

CPC ..... *B26B 21/46* (2013.01); *B26B 21/16* (2013.01); *B26B 21/222* (2013.01); *B26B 21/4056* (2013.01)

(58) Field of Classification Search

CPC ..... B26B 21/46; B26B 21/16; B26B 21/222; B26B 21/4056

USPC ..... 362/315

See application file for complete search history.

(56) References Cited

U.S. PATENT DOCUMENTS

| | | | | |
|---|---|---|---|---|
| 5,347,715 | A * | 9/1994 | Friedland | G06M 3/00 30/526 |
| 10,631,613 | B1 | 4/2020 | Totonelly | |
| 11,034,037 | B1 | 6/2021 | Frances | |
| 11,389,980 | B1 | 7/2022 | Vondahlen et al. | |
| 2009/0071008 | A1* | 3/2009 | Hart | B26B 21/222 30/34.05 |
| 2010/0122462 | A1 | 5/2010 | Ndou et al. | |
| 2019/0224868 | A1 | 7/2019 | Robinson et al. | |
| 2021/0122071 | A1 | 4/2021 | Pintzos | |
| 2021/0146562 | A1 | 5/2021 | Panagiotopoulou et al. | |
| 2022/0001558 | A1* | 1/2022 | Good | B26B 21/521 |
| 2022/0314477 | A1 | 10/2022 | Galanis et al. | |

(Continued)

OTHER PUBLICATIONS

All Office Actions; U.S. Appl. No. 17/492,094, filed Oct. 1, 2021.

(Continued)

*Primary Examiner* — Laura K Tso

(74) *Attorney, Agent, or Firm* — John M. Lipchitz

(57) ABSTRACT

A consumer appliance with a body. A cartridge removably mounted to the body. The cartridge having a surface with a first colored region and a second colored region. A control circuit positioned within the body. A first emitter that projects a first light at the first colored region and a second light at the second colored region. A first light sensor mounted the body that sends a first signal to the control circuit based on a color of light reflected from the first colored region. A second light sensor mounted to the body that sends a second signal to the control circuit based on a color of the light reflected from the second colored region.

20 Claims, 6 Drawing Sheets

(56) References Cited

U.S. PATENT DOCUMENTS

2022/0329246 A1 10/2022 Von Dahlen et al.

OTHER PUBLICATIONS

U.S. Appl. No. 17/492,094, filed Oct. 1, 2021, to Judith Habermann et al.
16042Q PCT Search Report and Written Opinion for PCT/US2022/076149 dated Jan. 27, 2023, 10 pages.

* cited by examiner

PERSONAL CARE APPLIANCE

FIELD OF THE INVENTION

The present invention relates to consumer appliances and more particularly to electronic consumer appliances having replaceable cartridges.

BACKGROUND OF THE INVENTION

Personal care appliances may include a durable component, such as a handle that is reused and a replaceable component, such as a cartridge that needs to be replaced after a certain amount of uses. Examples of personal care appliances may include, but are not limited to facial cleanser devices, toothbrushes and shaving razors. Replaceable cartridges may last for a month, or even longer. Thus, consumers typically lose track of how many times they have used the replaceable cartridges. Furthermore, performance of the replaceable cartridges may gradually decrease over time. Accordingly, the consumer may be less likely to perceive any performance changes that would indicate a new cartridge is needed.

A shaving razor or other personal care appliance may count the number of usages and feedback this information to the consumer. For some devices the manufacturer may recommend exchanging an attachment (e.g., cartridge) after a certain time of usage as some attachments decrease their functionality over the time and replacing helps to retain the performance and additional benefits of the device.

Some personal care appliances may provide a sensor for detecting the presence of a replaceable cartridge which resets an internal counter. However, these are not passive systems and require light emitter(s) (e.g., light emitting diodes or LEDs). Drawbacks of optical detection systems is that they can confuse the presence of a cartridge with just a low ambient light condition, which may be typical of a dimly lit bathroom early in the morning or late at night. Other drawbacks of present cartridge detection systems include resetting the usage count without additional feedback from the consumer thus leading to potential unintended resets.

Accordingly, there is a need to provide a personal care appliance that is capable of sensing the presence of an attachment (e.g., cartridge) in in all reasonably assumable illumination settings including low ambient light without the need for LEDs and accurately track attachment usage.

SUMMARY OF THE INVENTION

In one aspect, the invention features, in general, a consumer appliance with a body. A cartridge removably mounted to the body. The cartridge having a surface with a first colored region and a second colored region. A control circuit positioned within the body. A first emitter positioned on the body that projects a light at the first colored region. A second emitter positioned on the body that projects light at the second colored region. A first light sensor positioned on the body that sends a first signal to the control circuit based on a color of light reflected from the first colored region.

The foregoing aspect can include one or more of the following embodiments. The first colored region is a different color than the second colored region. The first light sensor sends a second signal to the control circuit based on a color of light reflected from the second colored region. A second light sensor sends a second signal to the control circuit based on a color of light reflected from the second colored region. The surface of the cartridge comprises a third colored region.

In another aspect, the invention features, in general a consumer appliance with a body. A cartridge is removably mounted to the body. The cartridge has a surface with a first colored region and a second colored region. A control circuit is positioned within the body. A first emitter is positioned on the body overlapping the first colored region and projecting a first light at the first colored region. A second emitter positioned on the body overlapping the second colored region and projecting a second light at the second colored region. A first light sensor positioned on the body between the first emitter and the second emitter. The first light sensor sends a first signal to the control circuit based on a color of light reflected from the first colored region.

The foregoing aspect can include one or more of the following embodiments. The first light sensor sends a second signal to the control circuit based on a color of light reflected from the second colored region. A consumer user interface is operably connected to the control circuit and the control circuit sends a signal to a consumer user interface based on the first signal and the second signal.

In another aspect, the invention features, in general, a consumer appliance with a body. A cartridge removably mounted to the body. The cartridge having a surface with a first colored region and a second colored region. A control circuit positioned within the body. A first emitter that projects a first light at the first colored region and a second light at the second colored region. A first light sensor mounted the body that sends a first signal to the control circuit based on a color of light reflected from the first colored region. A second light sensor mounted to the body that sends a second signal to the control circuit based on a color of the light reflected from the second colored region.

In another aspect, the invention features, in general, a cartridge with a housing defining an opening dimensioned to receive an optical sensor subassembly. One or more blades are mounted to the housing. The opening is defined by a surface having a first colored region and a second colored region that is a different color than the first colored region.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
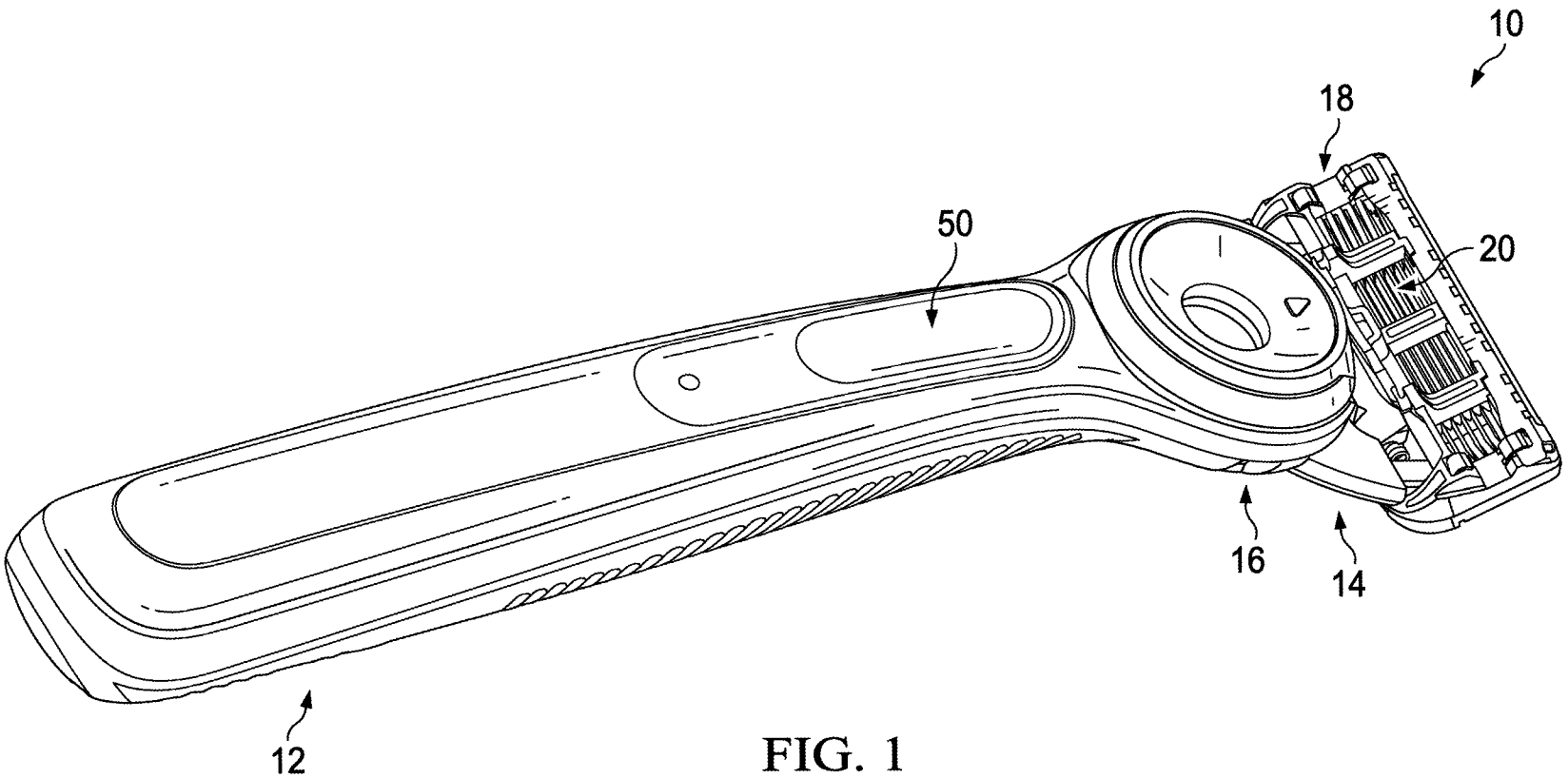
FIG. 1 is a top perspective view of one possible embodiment of a consumer appliance having an attached cartridge.
Figure 2:
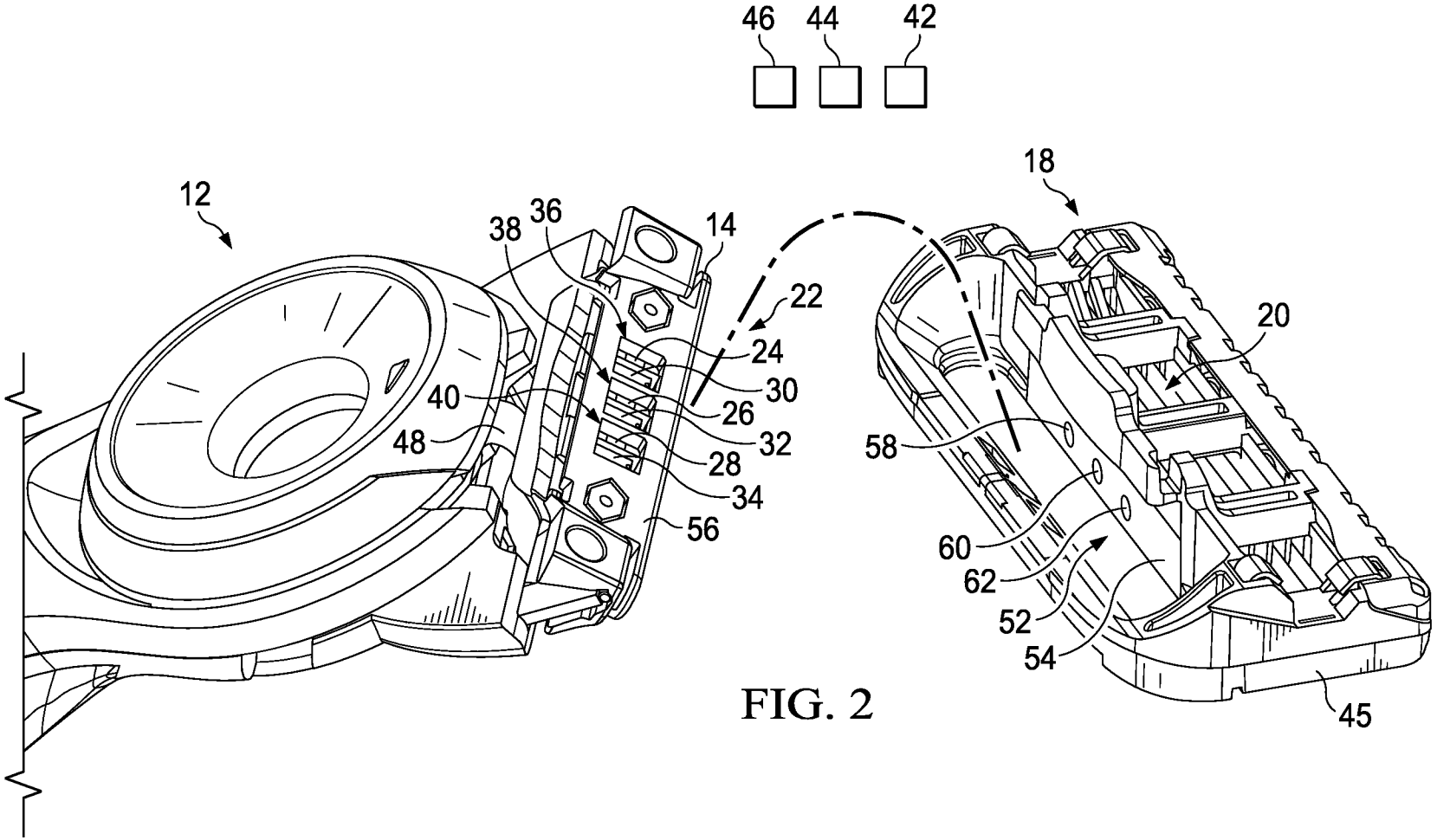
FIG. 2 is an enlarged perspective view of a proximal end portion of the consumer appliance of FIG. 1 with the cartridge detached.

Referring to FIGS. 1 and 2, one possible embodiment of the present disclosure is shown illustrating a consumer appliance 10. The consumer appliance 10 may include a handle 12 having a body 14 at a first end 16 of the handle 12. A cartridge 18 may be removably mounted to the body 14. The cartridge 18 may include one or more blades 20 for shaving. Although the consumer appliance 10 shown is a shaving razor, it is understood the consumer appliance 10 may also include toothbrushes, electronic air fresheners or other consumer devices having a replaceable cartridge.

The handle 12 may include an optical sensor subassembly 22. As will be explained in greater detail below, the optical sensor subassembly 22 may project one or more beams of light toward the cartridge 18. The optical subassembly 22 may also send one or more signals to a control circuit (not shown) based on a color of light reflected from the cartridge 20. For example, the optical subassembly 22 may include a first emitter 24, a second emitter 26, and a third emitter 28 positioned on the body 14 that project light. Although three emitters 24, 26 and 28 are shown, it is understood that more or less emitters may be used depending on the number of different cartridges 18 to be identified. The optical sensor subassembly 22 may include one or more light sensors 30, 32 and 34 on the body 14. In certain embodiments, one or more of the light sensors 30, 32 and 34 may be "RGB" sensors (optical sensor having have sensitivity to red, green, and blue). However, other optical sensors may also be used, such as photodiodes or a phototransistors for the light sensors 30, 32 and 34. The light sensors 30, 32 and 34 may be associated with one or more of the emitters 24, 26 and 28. For example, the first light sensor 30 may be associated with the first emitter 24, the second light sensor 32 may be associated with the second emitter 26, and the third light sensor 34 may be associated with the third emitter 28. The emitters 24, 26 and 28 may include LED (light-emitting diode) that projects a high intensity white light. Although three light sensors 30, 32 and 34 are shown, it is understood that more or less light sensors may be used depending on the number of different cartridges 18 to be identified. In certain embodiments, each of the emitters 24, 26 and 28 may be positioned within a respective pocket 36, 38 and 40 of the body 18. Similarly, each of the light sensors 30, 32 and 34 may be positioned within a respective pocket 36, 38 and 40 adjacent one of the respective emitters 24, 26 and 28. The pockets 36, 38 and 40 may prevent the emitters 24, 26 and 28 from interfering with one or more unintended light sensors 30, 32 and 34. In certain embodiments, one or more protective panels 42, 44, and 46 may cover the pockets 36, 38 and 40. For example, the one or more protective panels 42, 44, and 46 may be mounted to the optical subassembly 22 to protect various electronic components from water ingress.

A printed circuit board 48 may connect the optical subassembly 22 to a control circuit (not shown) positioned on or within the handle 12. It is understood that in certain embodiments, the printed circuit board 48, as well as other electrical components may be positioned outside of the handle 12 and sealed from water ingress. A consumer user interface 50 (FIG. 1) may be operably connected to a control circuit (not shown). In certain embodiments, the consumer user interface 50 may be positioned on the handle 12. The consumer user interface (e.g., a touch screen) may provide information to the user and receive input from the user regarding the function of the consumer appliance 10. It is understood that the consumer user interface 50 may also be physically separated from the handle 12, such as on a smart device (e.g., a phone or watch) or computer in the form of an app or a push notification requesting an input from the user. In such situations the control circuit (not shown) may still be operably connected to the consumer user interface 50 when the handle 12 is a connected handle that is wirelessly or wire connected to the smart device or computer having the consumer interface. The communication between handle 12 and consumer user interface 50 may happen directly (e.g., peer-to-peer) or via an intermediate cloud service.

The cartridge 18 may have a housing 45 defining an opening 52 dimensioned to receive the optical sensor subassembly 22. The blades 20 may be mounted to the housing 45. As will be explained in greater detail below, the opening 52 may be defined by a surface 54 that covers an outer surface 56 of the optical subassembly 22 (e.g., in a planar direction) when the cartridge 18 is properly mounted to the optical sensor subassembly 22. It is understood that the outer surface 56 may not be completely covered. The surface 54 may include one or more colored regions 58, 60 and 62. For example, the surface 54 may have a first colored region 58, a second colored region 60 and a third colored region 62. The colored regions 58, 60 and 62 may be the same color or different colors. In certain embodiments, the colored regions 58, 60 and 62 may be a different color than the housing 45. Shaving razor cartridges having different characteristics may have different colored regions which are capable of being recognized by the optical sensor subassembly 22. Although the colored regions 58, 60 and 62 are illustrated as circles positioned in a linear array, it is understood that any shape may be used, such as squares and rectangles. Furthermore, it is understood the colored regions 58, 60 and 62 may be positioned in a circular array. The colored regions 58, 60 and 62 may be spaced apart from each other or touching. In certain embodiments, the colored regions 58, 60 and 62 may be bonded to the surface 54. For example, the colored regions 58, 60 and 62 may be mounted to the surface 54 with adhesive. In other embodiments, the colored regions 58, 60 and 62 may be co-injection molded to the surface 54, printed or painted onto the surface 54. In certain embodiments, the surface 54 may be flat to allow for easy application of the colored regions 58, 60 and 62 to the surface 54.

As will be described in greater detail below, each of the colored regions 58, 60 and 62 may be associated with one or more of the emitters 24, 26 and 28 and one or more of the light sensors 30, 32 and 34. For example, when the cartridge 18 is mounted to the handle 12, the first colored region 58 may be associated with the emitter 24 and the light sensor 30. Accordingly, the first colored region 58, the emitter 24 and the light sensor may work together to send a signal to the control circuit (not shown). Similarly, the second colored region 60 may be associated with the emitter 26, and the light sensor 32. The third colored region 62 may be associated with the emitter 28, and the light sensor 34. In certain embodiments, the colored regions 58, 60 and 62 may overlap the respective emitters 24, 26 and 28 and/or respective light sensors 30, 32 and 34. For example, when the cartridge 18 is mounted to the handle 12 (e.g., the optical sensor subassembly 22 is inserted into the opening 52), the emitter 24 may overlap the colored region 58, the emitter 26 may overlap the colored region 60 and the emitter 28 may overlap the colored region 62.

Figure 3:
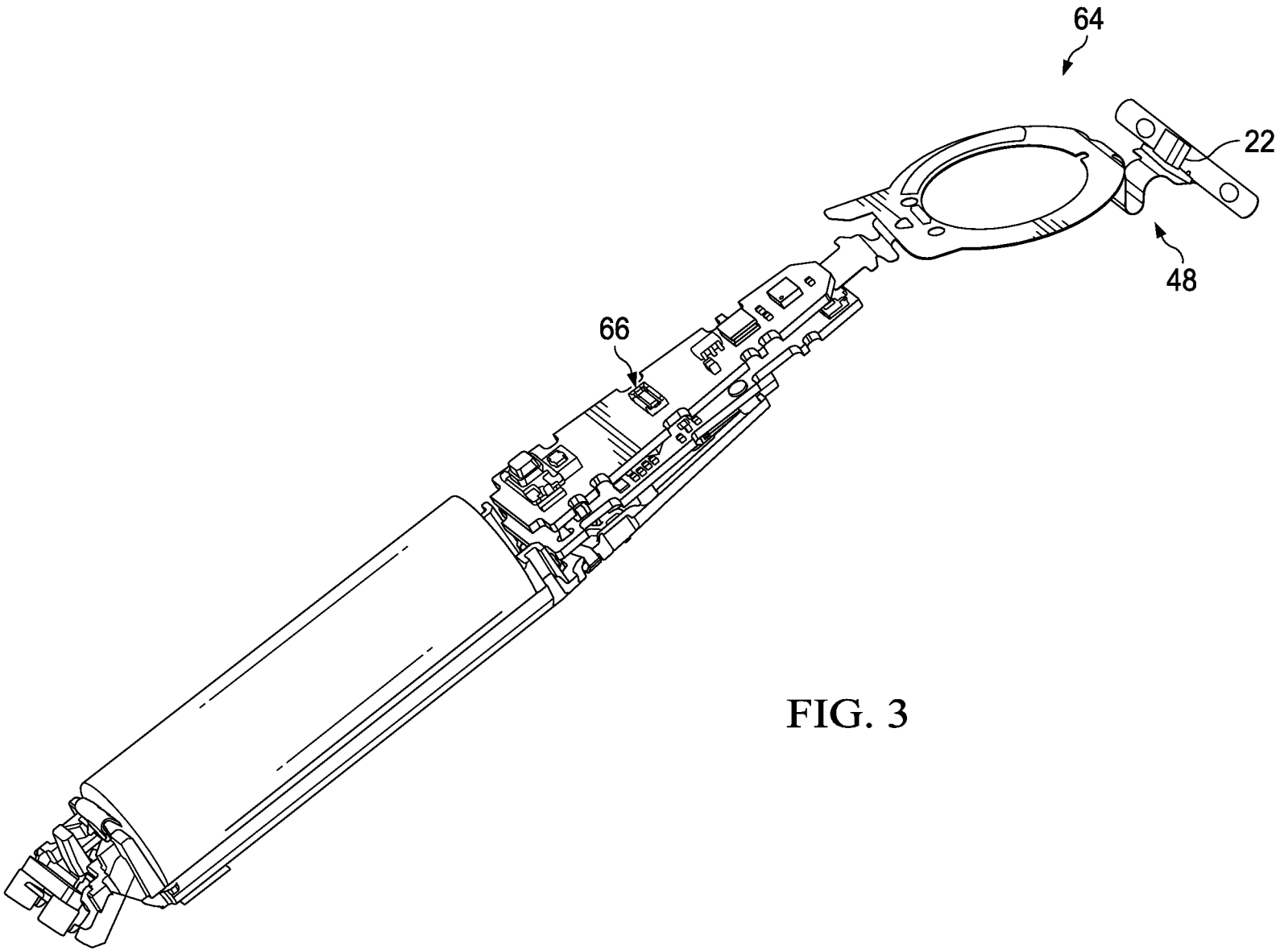
FIG. 3 is a perspective view of an electronic subassembly of the personal care appliance of FIG. 1.

Referring to FIG. 3, a perspective view of an electronic subassembly 64 of the consumer appliance 10 of FIG. 1 is illustrated. The electronic subassembly 64 may be positioned within the handle 12 of FIG. 1. The electronic subassembly 64 may include a control circuit 66 (e.g., a microcontroller). The control circuit 66 may be in electrical communication with the printed circuit board 48, which is in electrical communication with the optical sensor subassembly 22 mounted to the printed circuit board 48. The optical sensor subassembly 22 may produce one or more electrical output signals based on one or more of the colored regions 58, 60 and 62 of the cartridge 18 of FIG. 2.

Figure 4:
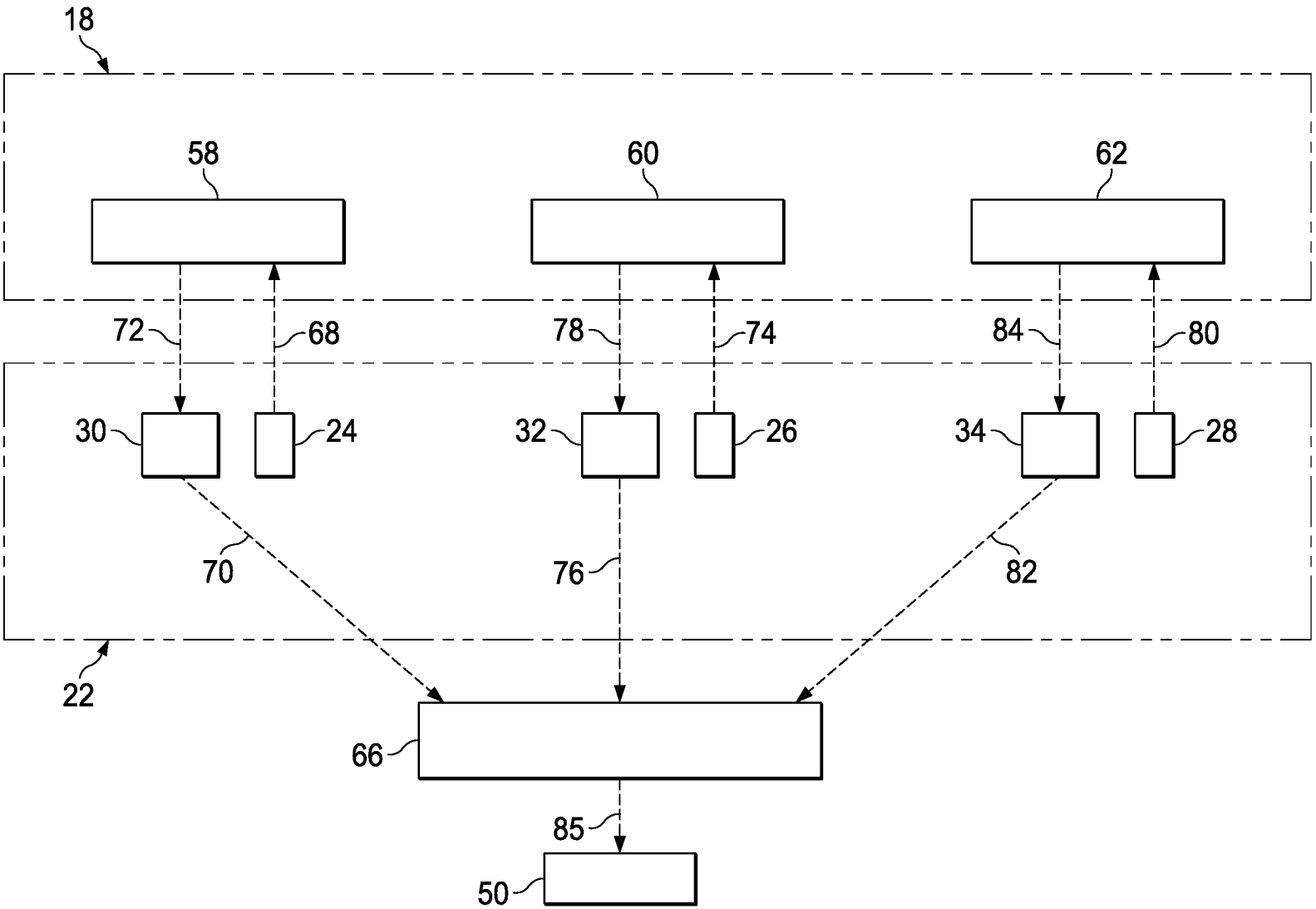
FIG. 4 is a first schematic view of an optical sensor subassembly.

Referring to FIG. 4, a schematic view of an interface of the cartridge 18 and the optical sensor subassembly 22 of the handle 12 is illustrated. The first emitter 24 may project a light 68 (i.e., a first light) at the first colored region 58. The first light sensor 30 may send a first signal 70 to the control circuit 66 via the printed circuit board 48 (FIG. 3) based on a color of a reflected light 72 (i.e., first reflected light) from the first colored region 58. In certain embodiments, the second emitter 26 may project a light 74 (i.e., a second light) at the second colored region 60. The second light sensor 32 may send a second signal 76 to the control circuit 66 via the printed circuit board 48 (FIG. 3) based on a color of a reflected light 78 (i.e., second reflected light) from the second colored region 60. In certain embodiments, the third emitter 28 may project a light 80 (i.e., a third light) at the third colored region 62. The third light sensor 34 may send a third signal 82 to the control circuit 66 via the printed circuit board 48 (FIG. 3) based on a color of a reflected light 84 (i.e., third reflected light) from the third colored region 62. It is understood that their may be variation in the manufacturing process for applying the colored regions 58, 60 and 62. Accordingly, one or more of the light sensors 30, 32 and 34 may send the corresponding signals 70, 76 and 82 to the control circuit 66 based on a predominant color of the respective colored regions 58, 60 and 62. The control circuit 66 may process one or more of the signals 70, 76 and 82 to send a signal 85 to the consumer user interface 50. For example, the consumer user interface 50 may indicate to the user the type of cartridge 18 that has been attached the handle 12 and other information about the cartridge, such as the number of blades or other benefits.

Figure 5:
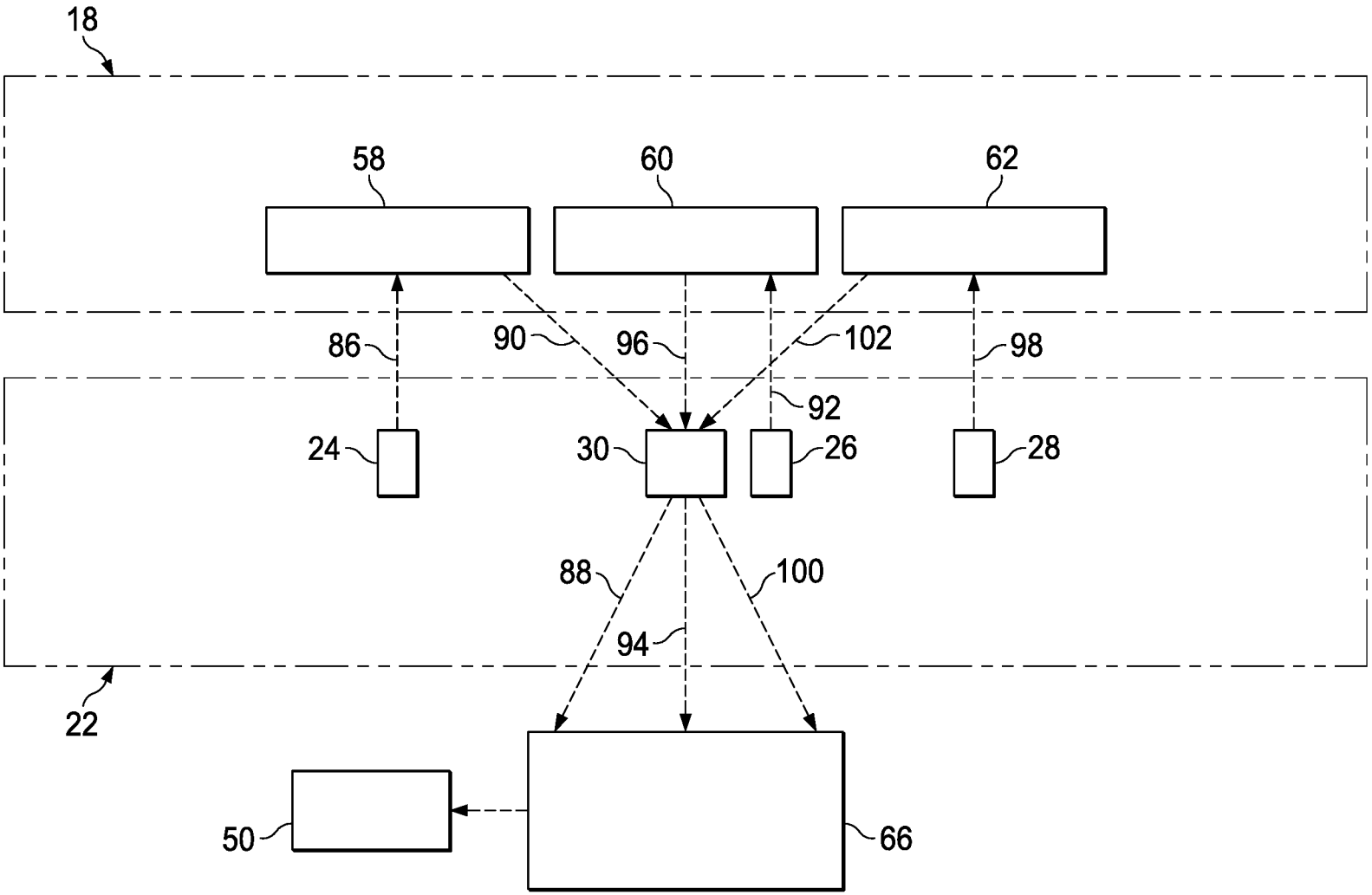
FIG. 5 is a second schematic view of an optical sensor subassembly.

It is understood that the optical sensor subassembly 22 may have different configurations. For example, the optical sensor subassembly 22 may utilize a greater number of the emitters 24, 26 and 28 than the light sensors 30, 32 and 34. Referring to FIG. 5, another possible configuration is illustrated for the optical sensor subassembly 22 in which one of the optical sensors 30 is associated with more than one of the emitters 24, 28 and 30. The optical sensors 32 and 34 are not shown in FIG. 4 for clarity. It is understood, the optical sensors 32 and 34 may be eliminated or simply switched off. The emitter 24 may project a light 86 (i.e., a first light) at the first colored region 58. The first light sensor 30 may send a first signal 88 to the control circuit 66 via the printed circuit board 48 (FIG. 3) based on a color of a reflected light 90 (i.e., first reflected light) from the first colored region 58. The emitter 26 may project a light 92 (i.e., a second light) at the second colored region 60. The first light sensor 30 may send a second signal 94 to the control circuit 66 via the printed circuit board 48 (FIG. 3) based on a color of a reflected light 96 (i.e., second reflected light) from the second colored region 60. The second signal 94 may be different that the first signal 88 (e.g., indicating different colors of the colored regions 58 and 60). The emitter 28 may project a light 98 (i.e., a third light) at the second colored region 60. The first light sensor 30 may send a third signal 100 to the control circuit 66 via the printed circuit board 48 (FIG. 3) based on a color of a reflected light 102 (i.e., second reflected light) from the third colored region 62. The third signal 100 may be different that the first signal 88 and/or the second signal 94 (e.g., indicating different colors of the colored regions 58, 60 and 62). The control circuit 66 may process one or more of the signals 88, 94 and 100 to send a signal 102 to the consumer user interface 50. For example, the consumer user interface 50 may indicate to the user the type of cartridge 18 that has been attached the handle 12 and other information about the cartridge 18, such as the number of blades or other benefits.

In certain embodiments, two or more of the emitters 24, 26 and 28 may project light sequentially at the respective colored regions 58, 60 and 62. In certain embodiments, two or more of the signals 88, 94 and 100 may be sent to the control circuit 66 sequentially. The light sensor 30 may send the signals 88, 94 and 100 to the control circuit 66 based on a predominant color of the respective colored regions 58, 60 and 62.

Figure 6:
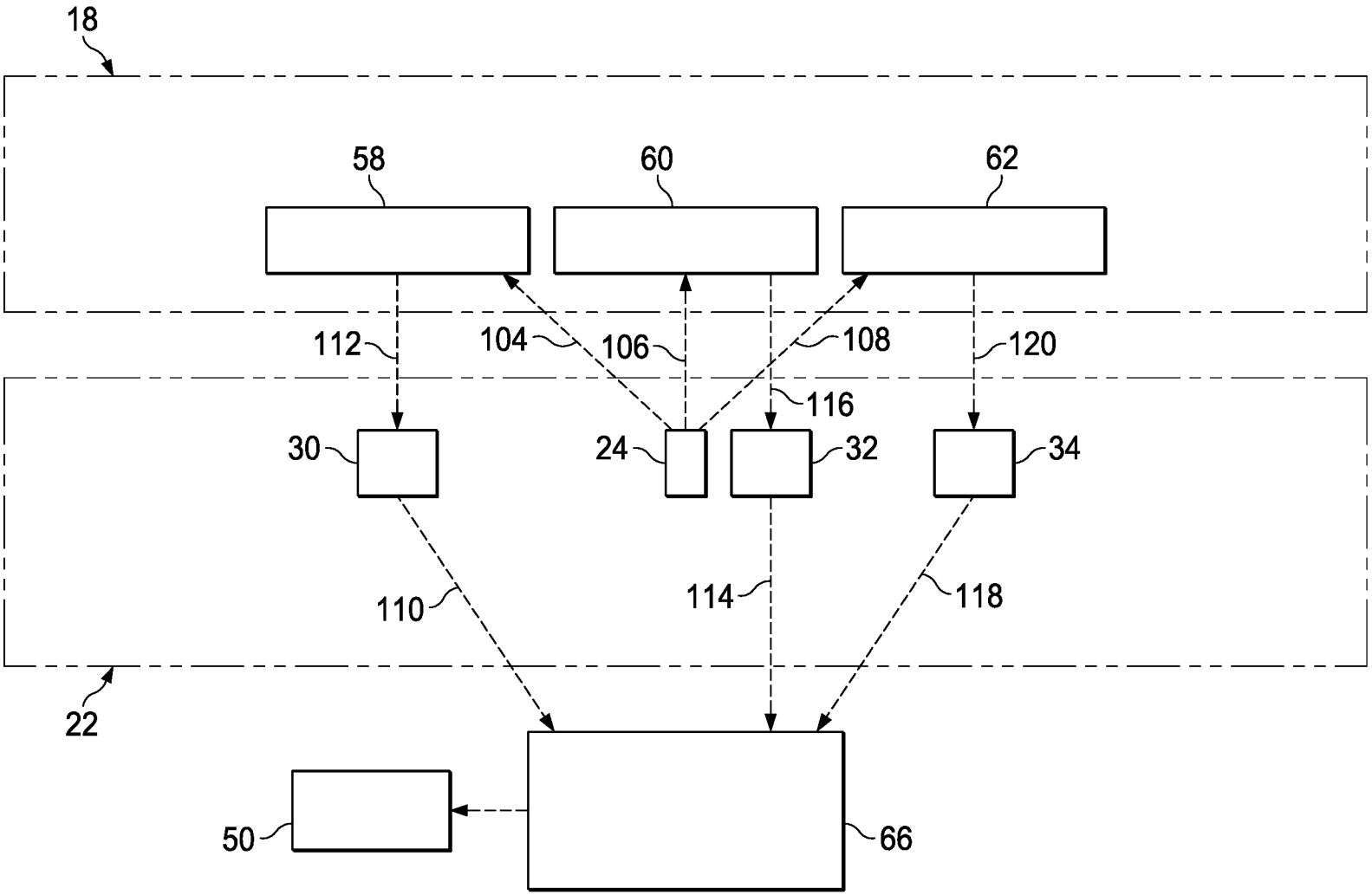
FIG. 6 is a third schematic view of an optical sensor subassembly.

Referring to FIG. 6, another possible configuration is illustrated for the optical sensor subassembly 22 in which one of the emitters 24 may be associated with more than one of the light sensor 30, 32 and 34. The emitters 26 and 28 are not shown in FIG. 4 for clarity. It is understood, the emitters 26 28 34 may be eliminated or simply switched off. The emitter 24 may project a light (i.e., a first light 102, a second light 104 and a third light 106) at the first colored region 58, the second colored region 60 and the third colored region 62. The first light 102, the second light 104 and the third light 106 may be projected by the emitter 24 at the same time or sequentially. The first light sensor 30 may send a first signal 108 to the control circuit 66 via the printed circuit board 48 (FIG. 3) based on a color of a reflected light 110 (i.e., first reflected light) from the first colored region 58. The second light sensor 32 may send a second signal 112 to the control circuit 66 via the printed circuit board 48 (FIG. 3) based on a color of a reflected light 114 (i.e., second reflected light) from the second colored region 60. The third light sensor 34 may send a third signal 116 to the control circuit 66 via the printed circuit board 48 (FIG. 3) based on a color of a reflected light 118 (i.e., third reflected light) from the third colored region 62. The light sensor 32.

The light sensors 30, 32 and 34 may send the signals 108, 112 and 116 to the control circuit 66 based on a predominant color of the respective colored regions 58, 60 and 62. The signals 108, 112 and 116 may be sent to the control circuit at the same time or sequentially. The control circuit 66 may process one or more of the signals 108, 112 and 116 to send a signal 102 to the consumer user interface 50. For example, the consumer user interface 50 may indicate to the user the type of cartridge 18 (FIG. 1) that has been attached the handle 12 and other information about the cartridge 18, such as the number of blades or other benefits.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". Therefore, the term "about" should be interpreted as being within typical manufacturing tolerances, as well as measuring instrumentation tolerances to those skilled in the art.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer appliance comprising:

a body;

a cartridge removably mounted to the body, the cartridge having a surface with a first colored region and a second colored region;

a control circuit positioned within the body;

a first emitter that projects a first light at the first colored region and a second light at the second colored region;

a first light sensor mounted to the body that sends a first signal to the control circuit based on a color of light reflected from the first colored region; and a second light sensor mounted to the body that sends a second signal to the control circuit based on a color of the light reflected from the second colored region.

2. The consumer appliance of claim 1 wherein the first emitter projects the light sequentially at the first colored region followed by the second colored region.

3. The consumer appliance of claim 1 wherein the first emitter projects the light at the first colored region and the second colored region at the same time.

4. The consumer appliance of claim 1 wherein the surface of the cartridge comprises a third colored region.

5. The consumer appliance of claim 4 further comprising a third light sensor mounted to the body that sends a third signal to the control circuit based on a color of the light reflected from the third colored region.

6. The consumer appliance of claim 1 wherein the first, second and third colored regions have a linear arrangement.

7. The consumer appliance of claim 1 wherein the first light sensor sends the first signal to the control circuit based on a predominant color of the first colored region.

8. The consumer appliance of claim 1 wherein the second light sensor sends the second signal to the control circuit based on a predominant color of the second colored region.

9. The consumer appliance of claim 1 further comprising a consumer user interface operably connected to the control circuit wherein the control circuit sends a signal to a consumer user interface based on the first signal and the second signal.

10. The consumer appliance of claim 1 wherein the first light sensor sends the first signal to the control circuit before the second light sensor sends the second signal to the control circuit.

11. The consumer appliance of claim 1 wherein at least one of the first light sensor and the second light sensor is an RGB sensor.

12. The consumer appliance of claim 1 wherein the first emitter is a LED.

13. The consumer appliance of claim 1 wherein the first light sensor and the second light sensor are positioned in separate pockets defined by the body.

14. A cartridge comprising:

a housing defining an opening dimensioned to receive an optical sensor subassembly;

one or more blades mounted to the housing, wherein the opening is defined by a surface having a first colored region and a second colored region that is a different color than the first colored region.

15. The cartridge of claim 14 wherein the first colored region is a different color than the second colored.

16. The cartridge of claim 15 wherein the surface comprises a third colored region that is a different color than the first colored region and the second colored region.

17. The cartridge of claim 16 wherein the colored regions are arranged linearly.

18. The cartridge of claim 14 wherein the first colored region and the second colored region are bonded to the surface.

19. The cartridge of claim 14 wherein the surface is flat.

20. The cartridge of claim 14 wherein the housing is a different color than the first colored region and the second colored region.

* * * * *